United States Patent [19]

Reysen

[11] Patent Number: 4,741,492

[45] Date of Patent: May 3, 1988

[54] CARRYING DEVICE FOR COILED WIRE

[75] Inventor: Richard D. Reysen, Eureka, Ill.

[73] Assignee: Keystone Steel & Wire, Peoria, Ill.

[21] Appl. No.: 755,415

[22] Filed: Jul. 15, 1985

[51] Int. Cl.[4] ..... B65H 49/00

[52] U.S. Cl. ..... 242/129

[58] Field of Search ..... 242/25 R, 26, 77.2, 242/79, 128, 129, 129.5, 141, 137.1

[56] References Cited

U.S. PATENT DOCUMENTS

| | | | |
|---|---|---|---|
| 51,220 | 11/1865 | Reynolds . | |
| 69,989 | 10/1867 | Harding . | |
| 259,214 | 6/1882 | Roberts | 294/67.1 |
| 264,547 | 9/1882 | McCosh . | |
| 264,778 | 9/1882 | Schellaberger . | |
| 290,969 | 12/1883 | Burrows . | |
| 296,273 | 4/1884 | Burrows . | |
| 348,857 | 8/1886 | Ford . | |
| 408,328 | 8/1889 | Steiner . | |
| 417,151 | 12/1889 | Cooney . | |
| 423,015 | 3/1890 | Wooster . | |
| 426,981 | 4/1890 | Asselin . | |
| 662,936 | 12/1900 | Hoefner . | |
| 932,808 | 8/1909 | Pelton . | |
| 1,344,274 | 6/1920 | Hubbard | 242/137.1 |
| 1,689,044 | 10/1928 | Meyer . | |
| 1,809,267 | 6/1931 | Cushing . | |
| 2,132,559 | 10/1938 | Broden . | |
| 2,203,799 | 6/1940 | Shaffer . | |
| 2,499,426 | 3/1950 | Swartout | 33/134 |
| 2,507,675 | 5/1950 | Morris . | |
| 2,630,980 | 3/1953 | Weaver | 242/129 |
| 2,663,892 | 12/1953 | Schaefer . | |
| 2,685,100 | 8/1954 | Schaeffer . | |
| 2,706,658 | 4/1955 | Jewell . | |
| 2,772,774 | 12/1956 | Rabuse . | |
| 2,944,759 | 7/1960 | Donovan | 242/129 |
| 3,044,728 | 7/1962 | Landgraf et al. . | |
| 3,139,986 | 7/1964 | Strock | 242/129 X |
| 3,186,658 | 6/1965 | Kohn et al. | 242/129 |
| 3,206,243 | 9/1965 | Miles . | |
| 3,251,623 | 5/1966 | Fredholm . | |
| 3,273,823 | 9/1966 | Taylor | 242/129 |
| 3,292,877 | 12/1966 | McMasters | 242/129 |
| 3,301,451 | 1/1967 | Halverson . | |
| 3,370,699 | 2/1968 | Gedge . | |
| 3,401,973 | 9/1968 | Marshall . | |
| 3,447,184 | 6/1969 | McGinley . | |
| 3,503,569 | 3/1970 | Gildart | 242/129 X |
| 3,778,002 | 12/1973 | Alleweireldt | 242/129 |
| 3,987,979 | 10/1976 | Knispel | 242/141 |

FOREIGN PATENT DOCUMENTS

| | | |
|---|---|---|
| 607683 | 11/1960 | Canada . |
| 1933076 | 10/1967 | Fed. Rep. of Germany . |
| 202920 | 8/1923 | United Kingdom . |

*Primary Examiner*—Donald Watkins

*Attorney, Agent, or Firm*—Allegretti, Newitt, Witcoff & McAndrews

[57] ABSTRACT

An improved carrying device for a coil of barbed wire having chordal supports and a handle. Each chordal support has an end section extending inside of the coil of wire and a central section within the hollow, central core of the coil. The handle includes hooks that interconnect to the central sections of the chordal supports. Even though the chordal supports rest only within the top section of the coil of wire, the entire coil may be lifted by raising the central section of the handle.

8 Claims, 3 Drawing Sheets

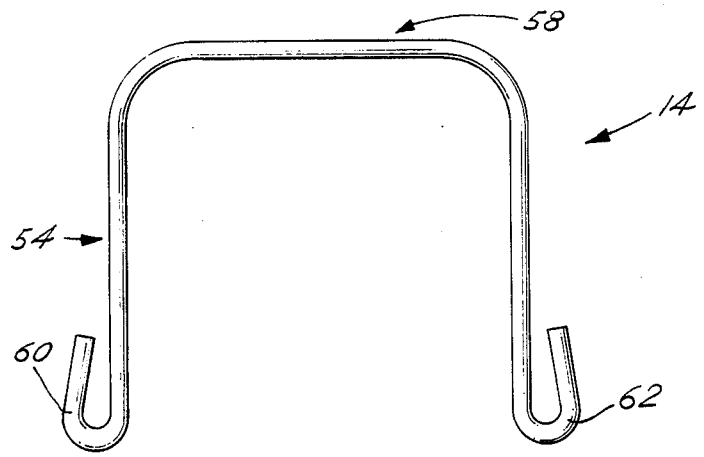
Fig. 5
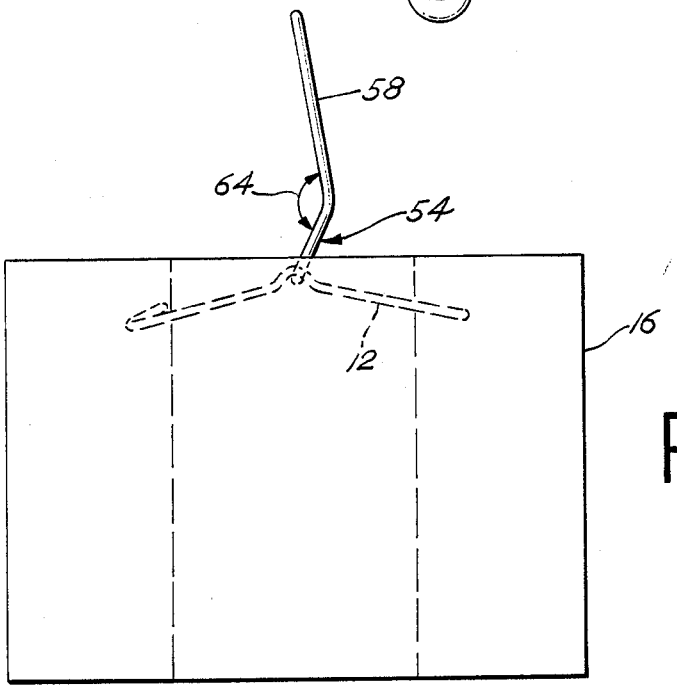
Fig. 6
Fig. 11
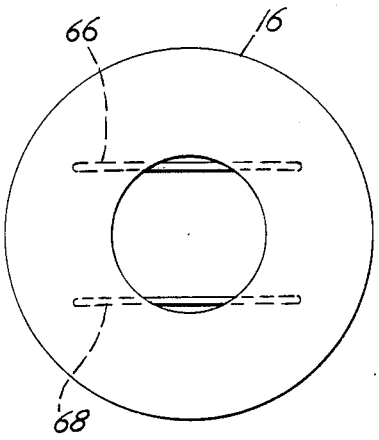
Fig. 12
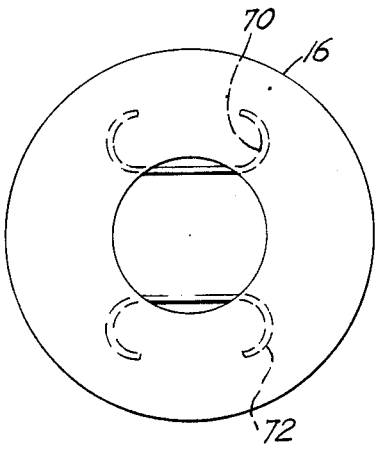
Fig. 13
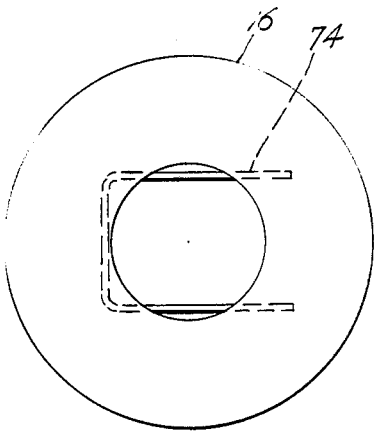

CARRYING DEVICE FOR COILED WIRE

BACKGROUND OF THE INVENTION

The present invention relates generally to a carrying device and more particularly to a device for carrying coiled barbed wire. After manufacture, wire is typically wrapped on to a winding mandrel to form the wire into a coil. Wire so wrapped in a coil can then be transported from the factory to the ultimate customers.

Coils of wire are heavy and awkward to transport by hand. Barbed wire coils are particularly troublesome, as the barbs may injure anyone who attempts to manually move the coil without sufficient protection. Unfortunately, many of the presently available devices for carrying coils of wire by hand are expensive to manufacture and difficult to use.

One type of available device is simply a drum that substantially encloses the entire coil of wire. U.S. Pat. No. 259,214 discloses a device for transporting wire, but includes a cylinder along the entire inside diameter of coil. U.S. Pat. No. 3,778,002 discloses a device for carrying coiled material as well, but requires a ring along the inner coil of wire.

The use of such cylinders and rings makes the carrying devices unnecessarily heavy and expensive to manufacture. In addition, many available devices are simply too large.

In addition, many of the devices now available cannot be incorporated with the winding mandrel. Moreover, many carrying devices which attach to (rather than enclose) the coil fail to securely hold the wire.

SUMMARY OF THE INVENTION

In a principal aspect the present invention is a device for carrying a coil of barbed wire. The device includes a chordal support having a central section separating two end sections. Each of the end sections may extend into the coil of wire, and the central section of the support lies within the hollow core of the coil of barbed wire.

A handle also includes a central section separating two end sections. Each of the end sections on the handle includes a hook for latching on to the central section of the chordal support. The central section of the handle provides a grip by which a carrying device and the attached coil of wire may be raised.

According to another feature of the present invention, the chordal support of the carrying device comprises a single, closed loop of wire. The loop of wire passes through the hollow core of the coil two times in order to form a pair of chordal supports. The central sections of the chordal supports each include a notch for receiving the hooks of the handle and thus stablizing the ends of the handle at substantially fixed positions along the chordal supports.

According to yet another aspect of the present invention, the chordal support includes indentations. These indentations guide and position the chordal support as it is pressed on to a winding mandrel and wire is then wound about the mandrel and chordal support.

Accordingly, an object of the present invention is an improved device for carrying a coil of barbed wire. Another object is a carrying device for barbed wire that may be more quickly and inexpensively manufactured. An additional object is a carrying device for barbed wire that is smaller, lighter, and substantially collapsible and that is therefore easier to use.

Still another object of the present invention is a carrying device for a coil of barbed wire that may more easily be incorporated into a winding mandrel. Another object of the present invention is that a carrying device that more securely holds the coil of wire. These and other objects of the present invention will be more fully understood by reference to the following detailed description of the preferred embodiment.

BRIEF DESCRIPTION OF THE DRAWING

The preferred embodiment of the present invention is described herein with reference to the drawing wherein:

FIG. 5 is a side view of the handle of the preferred embodiment shown in FIG. 1;

FIG. 6 is a side view of the preferred embodiment shown in FIG. 1, in association with a coil of wire;

FIG. 11 is a top plan view of a first alternative embodiment of the chordal supports shown in FIG. 1;

FIG. 12 is a top plan view of a second alternative embodiment of the chordal supports shown in FIG. 1; and FIG. 13 is a top plan view of a third alternative embodiment of the chordal supports shown in FIG. 1.

DETAILED DESCRIPTION OF THE PREFERRED EMBODIMENT

Figure 1:
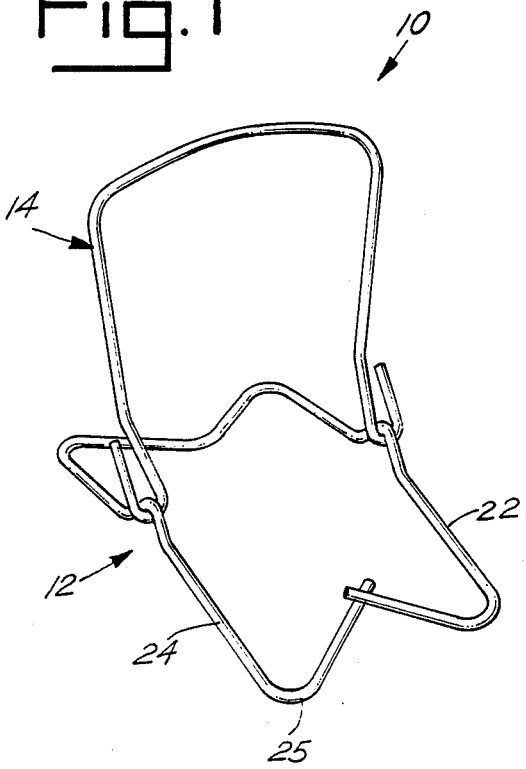
FIG. 1 is a perspective view of a preferred embodiment of the present invention.

Referring to FIGS. 1–13, the preferred embodiment of the present invention is shown as an improved device, generally designated 10, for carrying a coil of wire. The carrying device 10 includes a chordal support structure 12 and handle 14. The chordal support structure 12 may be directly affixed to a coil 16 of barbed wire 18.

Typically, after manufacture, barbed wire 18 is looped into a coil 16 in order to make its transport less unwieldy. To make the coil 16, a winding mandrel may be rotated to draw the barbed wire onto it. When a sufficient length of wire has been drawn onto the mandrel, the wire 18 is then removed as a coil 16.

Figure 2:
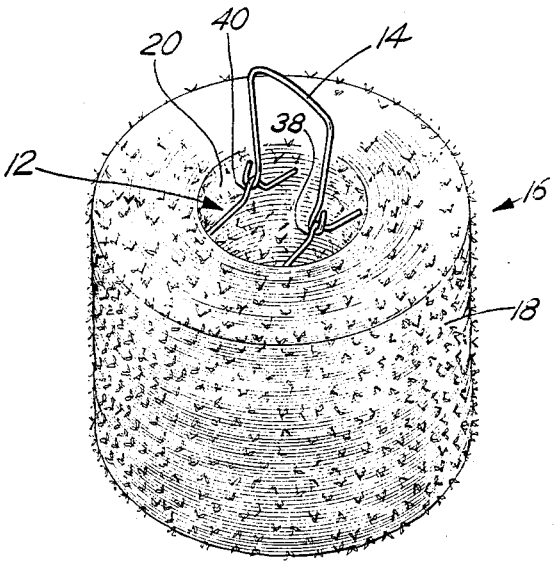
FIG. 2 is a perspective view of the preferred embodiment shown in FIG. 1, in association with a coil of barbed wire.

As shown in FIG. 2, the coil 16 resembles a cylinder and may have, for example, an outside diameter of approximately 1 to 1½ feet. However, the coil 16 defines a substantially hollow core 20 with a diameter of approximately 4 to 5 inches. The height of the coil may be, for example, 8 to 12 inches.

Throughout the present disclosure, a coil 16 of barbed wire 18 is used with the carrying device 10, as shown in FIG. 2. However, the term "barbed wire" is used to denote any type of elongate wire, cable, or strapping material which may adhere to itself.

Barbed wire 18 is particularly useful with the present invention, however, since the barbs along the wire readily interlock with each other. As a result, only a relatively small number of strands of wire 18 within the coil 16 need be held by the carrying device 10 in order to lift the entire coil 16.

In the preferred embodiment of the present invention, the chordal support structure 12 and handle 14 are each comprised of a single length of regular, silver, bright, galvanized, hard, industrial quality wire, approximately one-quarter inch in diameter. The chordal support structure 12 includes two chordal supports 22, 24. The two chordal supports 22, 24 each include a central section 26, 28, which rests in the substantially hollow core 20 of the coil 16, and two end sections 30, 32, 34, 36, which rest within the coil 16 itself. See FIG. 2.

Figure 3:
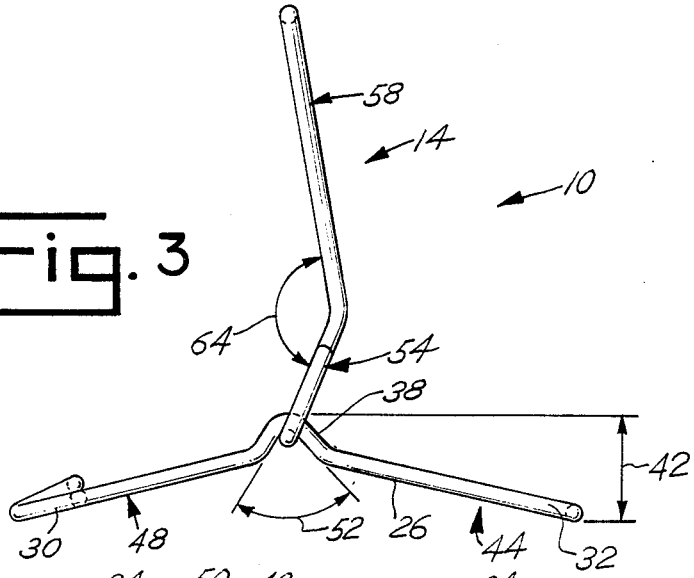
FIG. 3 is a side view of the preferred embodiment shown in FIG. 1.

Each of the chordal supports, 22, 24 also includes a notch 38, 40. As shown in FIGS. 2 and 3, the handle 14 is inserted into the notches 38, 40 of the chordal supports 22, 24, thereby substantially restraining the handle 14 from moving laterally along the length of the chordal members 22, 24.

The notches 38, 40 are each within the central sections 26, 28 of the chordal supports 22, 24 and are approximately one-quarter of an inch wide and one-half inch high. The distance (generally designated as 42 in FIG. 3) from the ends of the chordal supports 22, 24 to the top of the notches 38, 40 is approximately one inch.

Figure 4:
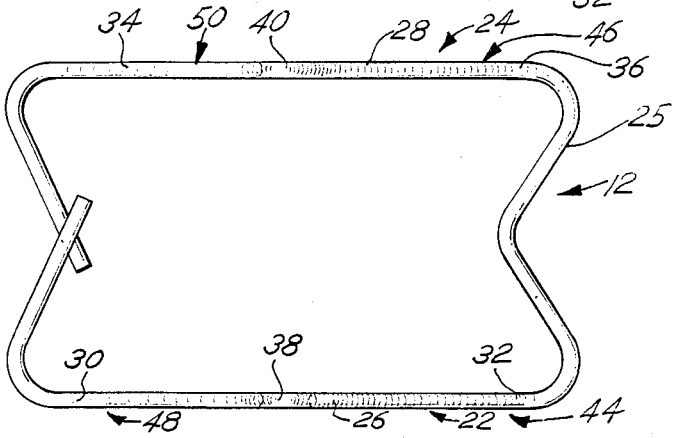
FIG. 4 is a top plan view of the chordal supports of the preferred embodiment shown in FIG. 1.

Moreover, each chordal support 22, 24 defines substantially straight, right and left segments 44, 46, 48, 50, as shown in FIGS. 3 and 4. Since both of the chordal supports 22, 24 are substantially similar, the following discussion only refers to the chordal support 22 for demonstrative purposes.

The left and right segments 44, 48 join at the notch 38, thus defining an obtuse angle 52. In the preferred embodiment shown in FIGS. 1–6, the obtuse angle 52 is approximately equal to 155°. A similar angle, however, such as one between 140° and 170°, will also be effective. Because the angled configuration of the left and right segments 44, 48 of the chordal support 22, applicants have found that it is easier to place the chordal support structure 12 within the coil 16, as shown in FIG. 2.

The handle 14 of the carrying device 10 is substantially U-shaped, having two end sections 54, 56 and a central section 58 therebetween. Each of the end sections 54, 56 include a hook 60, 62 for interconnecting the handle 14 to the notches 38, 40 in the central sections 26, 28 of the chordal supports 22, 24.

When the chordal support structure 12 is inserted into a coil 16 of wire 18, as shown in FIGS. 2 and 6, the ends 54, 56 of the handle 14 may be inserted into the substantially hollow core 20 of the coil 16 so that the hooks 60, 62 engage the notches 38, 40, as shown in FIGS. 2 and 3. With this arrangement, by manually lifting on the central section 58 of the handle 14, the entire carrying device 10 and the coil 16 may be raised and carried.

The handle 14 is approximately four inches high and four inches wide, as shown in FIG. 5. The central section 58 and end sections 54, 56 are separated by an angle 64 of approximately 145°. Because of the bend in the handle 14 between the central and end sections 58, 56, 54, the handle 14 may conveniently be laid over the coil 16 of wire 18 when the carrying device 10 is not in use.

For example, in FIG. 6, the handle 14 may be laid to the "left" to compactly rest on the coil 16. Such a collapsible feature of the carrying device 10 also allows the handle 14 to be folded down, substantially parallel to the chordal support structure 12, when the carrying device 10 is not in use with a coil 16 of wire 18.

In the preferred embodiment shown in FIGS. 2 and 6, for example, the chordal support structure 12 is placed approximately one inch from an end of the coil 16. The hooks 60, 62 of the handle 14 are then interconnected to the notches 38, 40 in the chordal supports 22, 24, and the central section 58 of the handle 14 is lifted to raise the entire coil of wire.

When so attached to the coil 16, the chordal support structure 12 is in the "top" section of the coil 16: the chordal support structure 12 only directly pushes upward on a relatively small portion of the total number of circular strands of wire 18 within the coil 16. Because the barbs of the barabed wire adhere to each other, such lifting of the top few strands allows the entire coil 16 to be lifted.

As shown in FIGS. 7–10, the carrying device 10 may be used with a winding mandrel 66. The winding mandrel 66 includes first and second flanges 68, 70 separated by a winding core 72. The winding core 72 includes a locking mechanism 74 and two chordal retaining slots, 76, 78, and defines both a longitudinal axis 80, and a diameter 82.

The winding core 72 is fixedly attached to the first flange 68. The locking mechanism 74 releasably interconnects the winding core 72 to the second flange 70.

As shown in FIGS. 7–10, the winding core 72 is substantially cylindrically shaped and its longitudinal axis 80 extends between the first and second flanges 68, 70. The predetermined diameter 82 of the winding core 72 is substantially perpendicular to the longitudinal axis 76. In the preferred embodiment, the diameter of the winding core 72 is approximately $4\frac{1}{4}$ inches.

Figure 8:
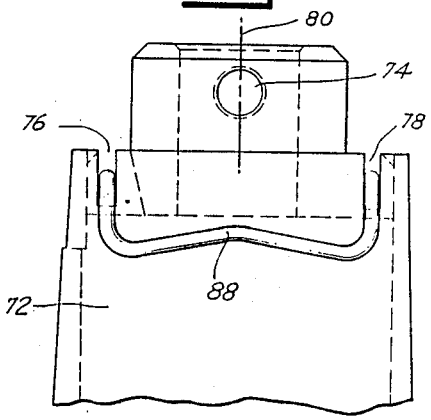
FIG. 8 is a partial side view of the chordal supports of FIG. 1 placed about a stationary winding mandrel.
Figure 9:
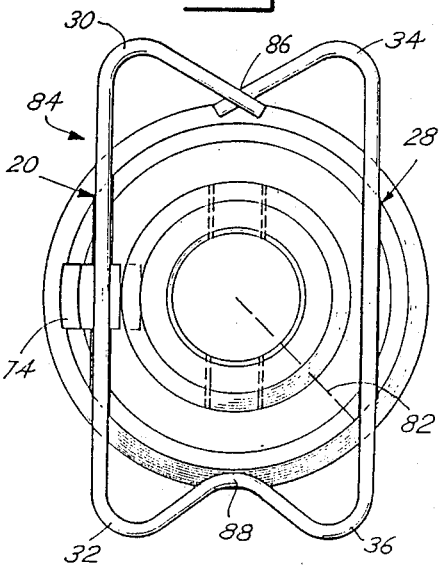
FIG. 9 is a top plan view of the chordal supports of FIG. 1 placed about a stationary winding mandrel.

As shown in FIGS. 8 and 9, the chordal retaining slots 76, 78 are parallel and about $2\frac{1}{2}$ inches long. The slots 76, 78 are also substantially perpendicular to the longitudinal axis 76 and separated from each other by a distance of about $2\frac{3}{4}$ inches.

The chordal support structure 12 shown in FIGS. 1–6 is a single, closed loop of such wire, generally designated 84. As shown in FIG. 9, the closed loop of wire 84 includes the two central sections 26, 28 and four end sections 30–36. When viewed from a top plan view as shown in FIG. 9, the two central sections 26, 28 appear substantially straight and parallel. The two central sections 26, 28 are separated by a distance of about $2\frac{3}{4}$ inches. The two end sections 30, 34 cooperatively define a first centering indentation 86; the two end sections 32, 36 also cooperatively define a second centering indentation 88 first and second indentations 86, 88. At their closest point, the first and second indentations 86, 88 are approximately 4 to $4\frac{1}{4}$ inches apart.

Accordingly, the winding core 72 may be disengaged from the second flange 70 and the closed loop 84 may be pressed, over the locking mechanism 74, onto the winding core 72. The retaining slots 76, 78 receive the two central sections 26, 28, substantially preventing movement of the closed loop 84 orthogonally to the slots 76, 78.

Furthermore, the first and second indentations 86, 88 of the closed loop 84 press against the winding core 72 of the mandrel 66. As a result, the indentations 86, 88 guide and center the closed loop 84 on the winding core 72. The central sections 26, 28 and indentations 86, 88 may deform slightly to snugly engage the winding core 72 and hold it in place.

Figure 10:
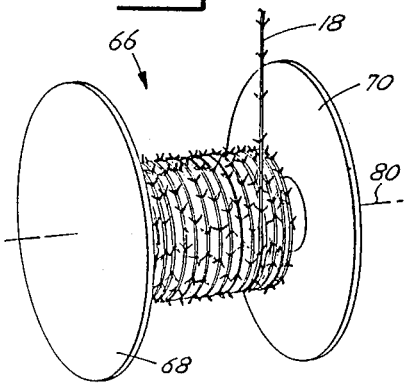
FIG. 10 is a perspective view of the chordal supports of FIG. 1 placed about an operating winding mandrel.

Thereafter, as shown in FIG. 10, the winding core 72 may be securely attached to the second flange 70 with the locking mechanism 74. The winding mandrel 66 may then be rotated to form a coil of wire about the mandrel 66.

The winding core 72 may be disconnected from the second flange 70 and the coil lifted from the winding core 72. The handle 14 may then be attached to the central sections 26, 28 of the chordal support structure 12. Thereafter, both the manufacturer and his customers may manually transfer the coil 16 by using the carrying device 10.

When the carrying device 10 is securely interconnected to the coil 16 of wire 18, as shown in FIG. 2, the carrying device 10 and coil 16 may be considered a single article of manufacture. Such an article may then, of course, be sold, and easily transported as a single product.

It is to be understood, of course, that changes in modifications may be made in the present embodiment without departing from the true scope and spirit of the present invention. For example, the chordal support structure 12 need not be a single closed loop 84 of wire. While it is preferred, it is not essential that the right and left segments 44–50 of the chordal supports 22, 24 relate at an obtuse angle to each.

Figure 7:
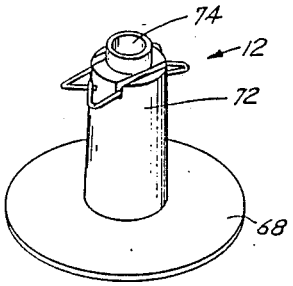
FIG. 7 is a perspective view of the chordal supports of FIG. 1 placed about a stationary winding mandrel.

As shown in FIG. 7, the carrying device 10 may include two separate, straight chordal supports 90, 92. As shown in FIG. 8, two chordal supports 94, 96 may be curved to more securely grasp the coil 16. Alternatively, a chordal support structure 98 may be U-shaped as shown in FIG. 9.

Preferred embodiments of the present invention have been described herein. The true scope and spirit of the present invention is defined by the following claims, to be interpreted in light of the foregoing specification.

I claim:

1. A carrying device for a coil of barbed wire having a substantially hollow core, said device cooperative with a winding mandrel used for forming the coil of wire, said mandrel of the type including a pair of flanges spaced by a generally cylindrical core member defining a longitudinal axis and a diameter, one end of the core member including first and second parallel slots generally perpendicular to the longitudinal axis, one of said flanges being removable from the one end of the mandrel to reveal the slots and to permit placement of the device therein for coil formation on the mandrel and device, said carrying device comprising in combination:

first and second generally straight, parallel and spaced chordal supports positionable in the parallel slots of the core member, each support having two opposite end sections and a central section therebetween, each of said end sections extending beyond the diameter of the core member into a coil wound thereon, and said central section positioned within the hollow core of the coil spaced from the sides thereof, said central sections including notch means within the hollow core of the coil also spaced from the sides, said end sections including means for projecting within the wound coil and for simultaneously engaging against the outside, generally cylindrical surface of the core member to thereby position the chordal support in the slot and prevent sliding motion in the slot when the coil is being formed on the mandrel; and a handle having two end sections and a central section therebetween, each of said sections including hooking means for interconnecting an end section of said handle to a notch means respectively of said central section of said chordal support, whereby said carrying device and coil of wire may be raised by lifting said central section of said handle.

2. A carrying device as claimed in claim 1 wherein each of said chordal supports include right and left sides, joined at said notch means at a predetermined, obtuse angle.

3. A carrying device as claimed in claim 1 wherein said chordal supports comprise a single, closed loop of wire.

4. A carrying device as claimed in claim 1 wherein said central sections of said carrying device are separated by a distance less than said diameter of said mandrel.

5. A carrying device as claimed in claim 1 in combination with a coil of barbed wire having a hollow core of a predetermined diameter.

6. A carrying device as claimed in claim 5 wherein each end section comprises a loop extension of the central section which loop extension extends into the coil for cooperative engagement with the wound coil and curves to engage the outside surface of the core member during formation of the coil of wire.

7. A carrying device as claimed in claim 1 wherein the chordal supports comprise a single closed loop of generally uniform diameter wire.

8. A carrying device as claimed in claim 1 in combination with a core member defining a longitudinal axis and a diameter, one end including first and second parallel slots spaced less than the diameter and perpendicular to the longitudinal axis.

* * * * *